United States Patent [19]

Widén

[11] 4,393,673

[45] Jul. 19, 1983

[54] CYLINDER LOCK

[75] Inventor: Bo G. Widén, Torshälla, Sweden

[73] Assignee: GKN Stenman AB, Eskiltuna, Sweden

[21] Appl. No.: 165,357

[22] Filed: Jul. 2, 1980

[30] Foreign Application Priority Data

Jul. 10, 1979 [SE] Sweden ..... 7906022

[51] Int. Cl.[3] ..... E05B 19/06; E05B 27/06

[52] U.S. Cl. ..... 70/358; 70/364 A; 70/406; 70/409

[58] Field of Search ..... 70/358, 364 A, 405, 70/406, 407, 419, 421, 409

[56] References Cited

U.S. PATENT DOCUMENTS

| | | | |
|---|---|---|---|
| 2,035,181 | 3/1936 | Molinare | 70/407 |
| 2,157,142 | 5/1939 | Olson | 70/406 |
| 2,426,104 | 8/1947 | Johnstone | 70/421 |
| 3,722,240 | 3/1973 | Spain | 70/364 A |
| 4,222,252 | 9/1980 | Tietz | 70/364 A |

*Primary Examiner*—Robert L. Wolfe

*Attorney, Agent, or Firm*—Pennie & Edmonds

[57] ABSTRACT

A cylinder lock with a cylinder core rotatable in a housing, a side bar in a recess extending axially in a peripheral part of the cylinder core and biassed outwardly to engage a recess in the housing which is shaped to retract the side bar upon turning the cylinder core, the side bar having a number of lugs which must engage in waisted portions of locking pins of a row thereof guided in bores in the cylinder core to permit retraction of the side bar. The waisted portions of the pins are identically positioned with respect to ends thereof, and the lugs are differently positioned on the side bar, the side bar having guide portions which extend between the locking pins when the side bar is retracted and which engage guide surfaces to resist any tendency for the side bar to become misaligned or jammed.

5 Claims, 15 Drawing Figures

CYLINDER LOCK

BACKGROUND TO THE INVENTION

1. Field of the Invention

This invention relates to a cylinder lock of the type comprising a housing, a cylinder core mounted for rotation in said housing, a slot extending into the cylinder core parallel to the rotational axis thereof, for receiving a key, at least one row of locking pins guided in bores in said cylinder core and being movable against spring means by a key which engages ends of the pins when the key is inserted into the slot, and at least one side bar accommodated in a recess extending axially in a peripheral part of the cylinder core, the or each side bar being spring biassed outwardly of the cylinder into engagement with a recess in the housing which recess is shaped to retract the side bar into the cylinder core upon turning the cylinder core. In such a lock, turning of the cylinder core is dependent upon the correct key being inserted to place the locking pins in respective positions in their bores to permit retraction of the side bar.

2. Description of Prior Art

U.S. Pat. No. 2,070,333 (Liss) discloses a lock of the kind set forth above, having two side bars which co-operate with a single row of locking pins which have pointed ends and are controlled by a coded surface of sawtoothed appearance provided along the edge of the blade of a key. The locking pins are provided with waisted portions at different locations along the various pins, and the side bars can retract to permit turning of the cylinder of the lock when the pins have been set that their waisted portions line up with the side bars.

The side bars are relatively thin, and have straight edges which engage the locking pins (which are of circular section). Thus wear is likely to occur at the regions of contact between the pins and side bars, and in addition wear is likely to occur between the pointed ends of the pins and the key. In addition to these disadvantages, the pins must be made to great accuracy.

A further form of cylinder lock is disclosed in U.S. Pat. No. 3,080,744 (Spain), in which lock a side bar co-operates with flat tumblers of identical form, the side bar having differently located recesses along its length. However, lever tumblers as disclosed are highly subject to wear by engagement with the key, and the number of possible combinations which can be achieved in a lock of a given size is comparatively small because available space is not fully utilised.

Yet another lock construction is described in U.S. Pat. No. 3,035,433 (Testa). This lock has a side bar which co-operates with flat lever tumblers, and requires the provision of many different shapes of lever tumbler. Further, the conditions under which the side bar and tumbler levers engage can cause the side bar readily to become jammed.

Yet further forms of lock are described in Swedish patent specification No. 385,228 (Medeco) and U.S. Pat. No. 3,499,302 (Spain).

SUMMARY OF THE INVENTION

It is the object of the present invention to provide a cylinder lock in which the above mentioned disadvantages of known cylinder locks are eliminated or reduced.

According to the present invention, we provide a cylinder lock comprising;

(a) a housing, (b) a cylinder core mounted for rotation in said housing, (c) a slot extending into the cylinder core parallel to the rotational axis thereof, for receiving a key, (d) at least one row of locking pins guided in bores in said cylinder core and being movable against spring means by a key which engages ends of the pins when the key is inserted into the slot, (e) at least one side bar accommodated in a recess extending axially in a peripheral part of the cylinder core, said at least one side bar being spring biassed outwardly of the cylinder into engagement with a recess in the housing which recess is shaped to retract the slide bar into the cylinder core upon turning the cylinder core, (f) said locking pins having operative waisted portions, and the or each said side bar having a number of lugs which must engage in said waisted portions of said pins of a row to permit said retraction, said waisted portions of the pins of the or each row being identically positioned on said pins of said row with respect to said ends of the pins of the row, and said lugs being respectively position on the or each side bar so as to engage said waisted portions when the pins of a row have been set in predetermined positions by the key when the key is in an operative position, (g) the or each side bar including guide portions which extend between the pins of a row at least when the side bar is retracted into the cylinder and engage with surfaces in the cylinder to resist misalignment of the side bar.

This invention enables manufacture of the lock to be simplified because the positions of the operative waisted portions in the locking pins are identical. The different positioning of the lugs on the or each side bar means that the side bar is relatively thick, and hence strong, while the provision of the guide portions on the or each side bar means that despite the side bar's thickness it is accurately and reliably guided in its recess so as to reduce or eliminate any risk of its sticking or jamming.

The lugs on one or each side bar may be disposed between the said guide portions and be of arcuate shape, so as to engage a substantial part of the peripheral surface of the locking pins except when the key is in its operative position. By this means engagement between the side bar and pins is improved, so that if an attempt is made to unlock the lock with the wrong key the load between the side bar and pins is distributed over a greater area. This increases the security of the lock against forced entry.

A further aspect of the present invention is concerned with the form of the key and the mode of co-operation between the locking pins and key. According to this aspect of the invention, there is provided the combination of a cylinder lock as set forth above and a key therefor, said key comprising a blade having an edge a longitudinally extending portion of which at one side of the blade affords a coded surface for engaging end portions of the pins, said coded surface including code portions for holding respective pins in predetermined positions by engaging only a segment of said end portion of each pin spaced from the pin centre line when the key is an operative position in said slot, and transition portions which extend lengthwise between adjacent code portions and which engage and guide the pins substantially for the whole of the distance between adjacent code portions as the key is moved into and out of its operative position, each transition portion having a concavely curved cross-sectional shape transverse to its length and which is constant over the whole length of the transition portions so that there is a arcuate region of engagement between the transition portion and pin as the latter is guided by the transition portion, the code portions and transition portions being open to said one side of the key blade and being spaced from the other side of the blade so that there is a thickness of material between said portions and said other side.

The segmental engagement between the end portions of the pins and the code portions of the key, and arcuate engagement between the transition portions of the coded surface of the key and the pins, as compared with point contact between pins and key proposed hitherto, enables available space in the cylinder core of the lock to be utilised more fully, since the pins need not be positioned centrally therein but can be offset towards the side bar. The coded surface on the blade of the key can be located below the level of the top of the key blade, so that the whole of each pin can be accommodated in the cylinder core despite the the fact the pins are laterally offset. This opens the possibility for providing a further row of pins and side bar in the cylinder core opposite the first row, to increase the combination possibilities of the lock.

The invention also provides a key for the lock and a method of manufacturing the key.

BRIEF DESCRIPTION OF DRAWINGS

The invention will now be described by way of example with reference to the accompanying drawing, of which.

DESCRIPTION OF PREFERRED EMBODIMENTS

Figure 1A:
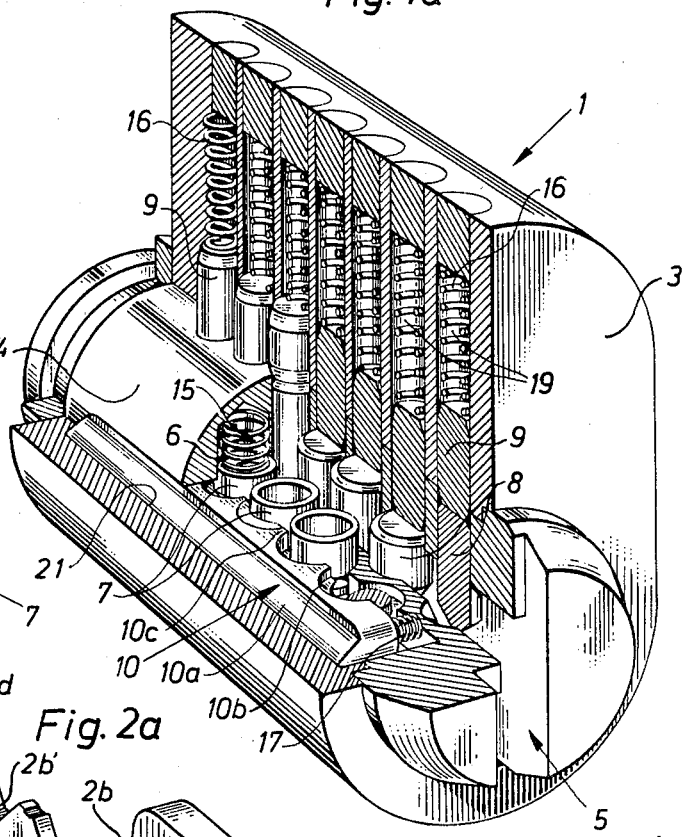
FIG. 1*a* is a partly cut away perspective view of a cylinder lock according to the invention.

Referring firstly to FIGS. 1*a* to 4, there is shown a cylinder lock comprising a housing 3 and a cylinder core 4 received for rotation in the housing. The cylinder core 4 has a slot 5 for receiving a key 2 and which extends parallel to the axis of rotation of the cylinder core.

The cylinder core 4 has a row of bores 6 which are laterally offset relative to the rotational axis of the cylinder core. Each bore 6 receives a locking pin 7, each pin 7 having a waisted portion 7*a* of smaller diameter than the remainder of the pin. The waisted portions 7*a* are all at the same position along their respective pins. A spring 15 is disposed in each bore, and biasses its respective pin downwardly having regard to the orientation shown in FIG. 1*a*, and the pins are movable against the springs when a key 2, as described hereinafter, is introduced into the slot 5.

In the peripheral part of the cylinder core 4 is a longitudinally extending recess 20 which accommodates a side bar 10. The side bar 10 has an outer part 10*a* of V-section, engageable with a complementary V-section recess 21 formed in the interior of the housing 1, when the cylinder core is in the appropriate angular position within the housing. Springs 17 are disposed between the ends of the side bar and rear faces of the recess 20 for biassing the side bar outwardly, and the side bar can be displaced inwardly against the action of such springs by rotating the cylinder core 4, provided that the correct key is inserted as described below.

Figure 1B:
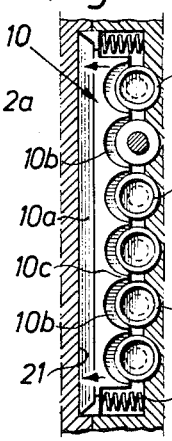
FIGS. 1*b* and 1*c* are plan views illustrating how a side bar of a cylinder lock according to FIGS. 1 co-operates with a row of waisted pins.
Figure 1C:
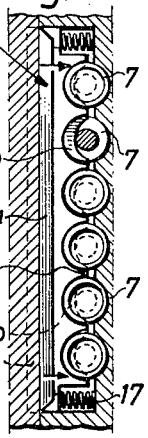
Figure 3:
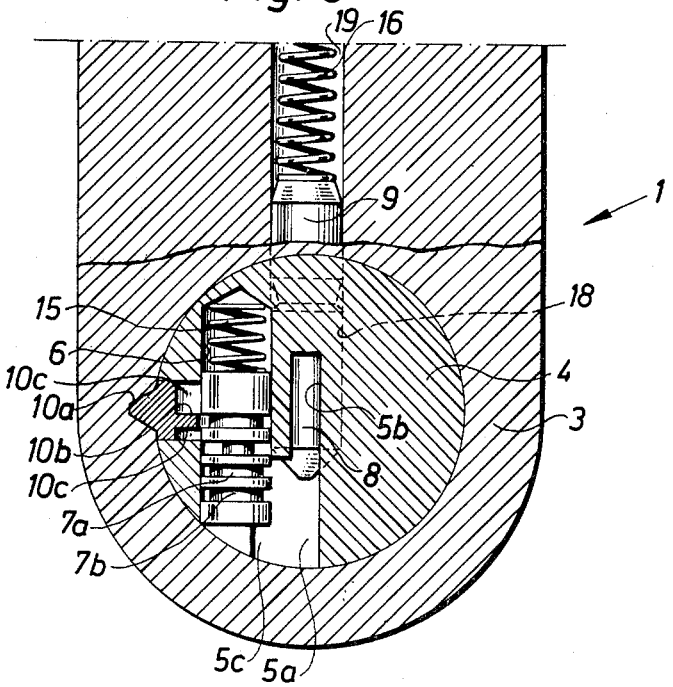
FIG. 3 is a sectional view of a cylinder lock shown in FIG. 1*a*.
Figure 4:
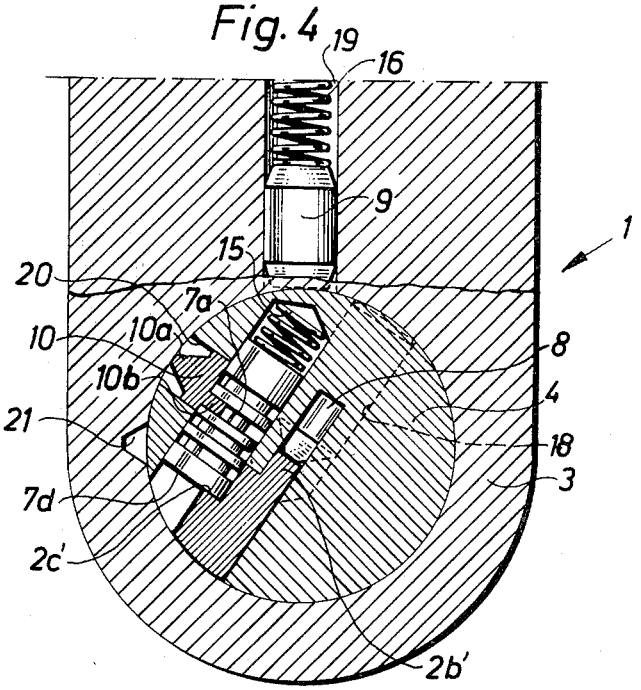
FIG. 4 is a sectional view corresponding to FIG. 3 of the lock shown in FIG. 1*a* subsequent to inserting a key thereinto and rotating the cylinder core.

The side bar 10 is provided along its inner side with a number of lugs or shoulders 10*b* which are of arcuate shape as seen in FIG. 1*b* and FIG. 1*c*. These lugs 10*b* are located at different vertical positions or heights in the side bar, and to permit the side bar to be retracted when turning of the cylinder is attempted, must enter the waisted portions 7*a* of respective pins. Because the pins 7 are identical, they must assume different vertical positions within their bores in the cylinder in order to permit retraction of the side bar. These vertical positions of the pins are set by a coded surface which is formed on a side part 2*c* of the key 2.

Because the lugs 10*b* are of arcuate shape, they will engage with a relatively great part of the periphery of the pins if the pins are not in the correct position to permit retraction of the side bar. This is advantageous in that it reduces wear on the pins and side bar. Between the lugs 10*b* on the side bar 10 are guide parts 10*c*. These lie between the pins 7 when the side bar is retracted, and engage upper and lower guide surfaces of the recess 20 between its intersections with the bores 6. This assists in guiding the side bar in the recess, thereby preventing the side bar from jamming or sticking.

Figure 2B:
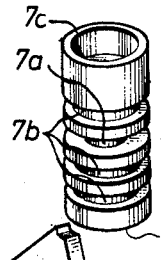
FIG. 2*b* is a perspective view in larger scale of pins associated with the lock, said pins being arranged to co-operate with the coded side part of the key.
Figure 2A:
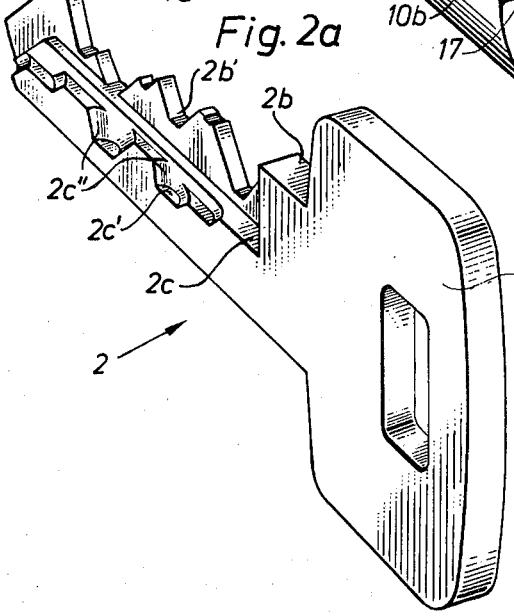
FIG. 2*a* is a perspective view of a key for a cylinder lock according to FIG. 1*a*.

The key 2 is illustrated in detail in FIG. 2*a*, and has a head 2*a* by which the key can be gripped and a blade 2*b*. The blade 2*b* carries an edge code 2*b'*, for engagement with a row of conventional pin tumblers disposed centrally in the cylinder. In FIG. 1*a*, there is shown a set of such conventional pin tumblers, with lower pins 8 in bores 18 in the cylinder core, and upper pins 9 in bores 19 into the housing, acted on by springs 16. The slot 5 in the cylinder core has a part 5*a* which receives the blade of the key, a part 5*b* which receives the coded part 2*b'* of the blade, and a part 5*c* receiving the side part of the blade.

The side part 2c to one side of the blade 2b carries a coded surface which co-operates with the pins 7. The coded surface comprises code portions 2c', which take the form of ledges with which the lower end surfaces of the pins engage when the key is fully inserted into the lock cylinder core to determine the position of the pins, and inclined transition portions 2c'' between the code portions 2c' for moving the pins as the key is inserted into and removed from the cylinder core.

When a pin is lying on one of the code portions 2c' of the coded surface of the key, there is flat contact between the key and pin over a segment of the pin's lower end surface 7d. The transition portions 2c'' of the coded surface have, viewed along such portions, a concavely curved cross-sectional shape so that when a pin is resting on a transition portion there is an arcuate region of contact between the the pin and key. The result of this is that when the key is inserted into and removed from the cylinder, the pins are readily moved up and down in their respective bores and finally adopt accurately defined positions therein. Further, there is a resistance to wear because there is always a relatively great contact area between the key and pins.

Geometrically at least the transition portions 2c'' of the key are part of a surface described by a point rotating at a fixed distance about and moving parallel to an axis which lies parallel to the axes of the pins 7, such axis moving relative to the key blade longitudinally thereof while remaining at a constant distance from and orientation relative to the blade. The fixed distance at which the point rotates is preferably substantially equal to the radius of the pins 7, or greater than such radius, the best engagement between the pins and key being obtained if the radius is identical to the pin radius. In this case, the axis preferably moves in a plane which bears the same relative relationship to the key, in terms of the distance therefrom and relative orientation, as the plane which contains the axis of the pins 7.

In other words, the movement of the point describing the coded surface of the key, relative to the key is substantially the same as the relative movement which occurs between pins and key as the key is inserted into and removed from the cylinder.

As the key is inserted into and removed from the cylinder, a torque is produced on the pins by virtue of the segmental contact between the bottoms of the pins and the code portions of the key surface, and the arcuate contact between the pins and transition portions of the coded key surface. This causes the pins to rotate, so that any wear which does occur is not concentrated at one particular part of each pin.

As illustrated, the end surface 7d of each pin, which co-operates with the coded surface of the key, is flat. This simplifies manufacture of the pins. However, the surface could be frusto-conical or curved. For these configurations of pin, the coded surface of the key would be described geometrically in substantially the same manner as above.

The pin 7 illustrated in FIG. 2b has further waisted portions 7b which are shallower than the waisted portion 7a. These additional waisted portions 7b render the lock difficult to pick because the lugs 10b on the side bar can partially enter these waisted portions but can not enter sufficiently to permit side bar retraction. If someone attempts to pick the lock, these shallower waisted portions give a false indication of setting the pin in its correct position. At least one of the pins 7 can also be provided with additional waisted portions of sufficient depth to permit side bar retraction. These will be located at mutually different positions along respective pins, and would enable the lock to be opened with a master key, in known manner.

Figure 5:
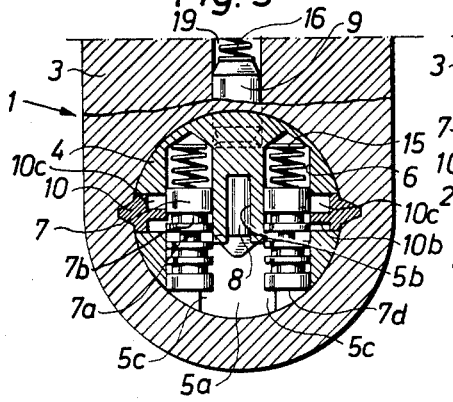
FIGS. 5 and 6 are sectional views corresponding to FIGS. 3 and 4 of an alternative embodiment provided with two rows of pins co-operating with a side bar for use with a key having two coded side parts.
Figure 6:
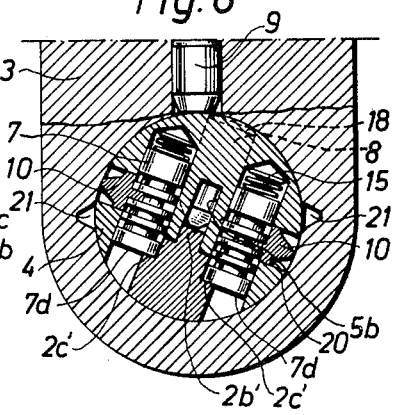

Referring now to FIGS. 5 and 6 of the drawings, there is shown a lock in which two rows of pins 7, co-operating with respective side bars, are provided on opposite sides of the cylinder core 4. In this case, the key slot in the cylinder has a central part 5b for receiving the blade of the key (which has a coded surface co-operating with a conventional set of pin tumblers) and two side parts 5c for accommodating key side parts 2c for coded surface 2c'. The sets of pins 7 and side bar parts operate in the same manner as described above in relation to FIGS. 1 to 4, and like numerals denote corresponding parts.

This construction provides a cylinder lock with a particularly large number of locking combinations, despite the small dimensions of the cylinder. The codes operating the two sets of pins 7 may be different from one another.

Figure 7:
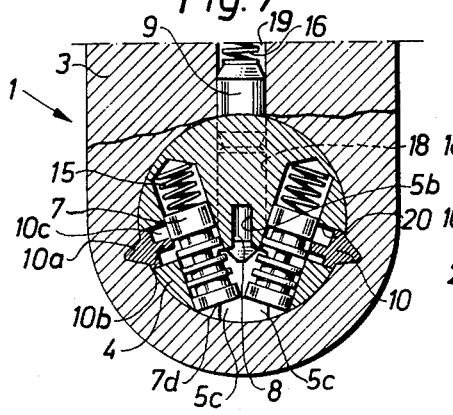
FIGS. 7 and 8 are corresponding sectional views of a further embodiment in which planes through the two rows of pins form an acute angle with one another.
Figure 8:
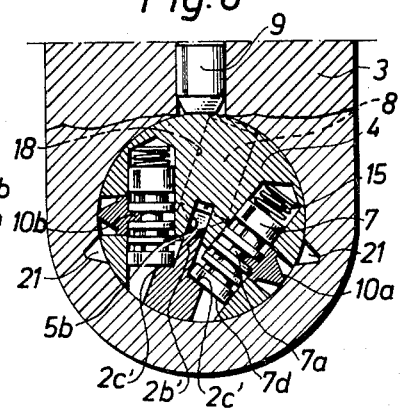

FIGS. 7 and 8 show a modification of the lock of FIGS. 5 and 6, in which the planes of the central axes of the rows of pins 7 form an acute angle with one another instead of being parallel. The angle between each plane and a central longitudinal plane of the slot is not more than about 30° to 35°. This enables the available space in the cylinder to be utilized more fully.

Figure 9:
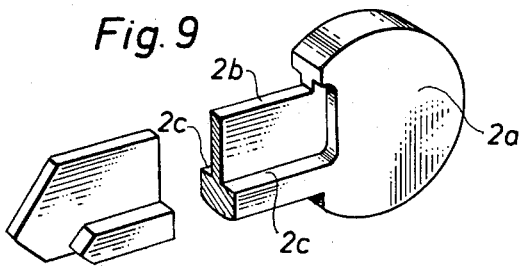
FIGS. 9 and 10 are perspective views illustrating the embodiment of a key blank for manufacturing keys in accordance with FIG. 2*a*.
Figure 10:
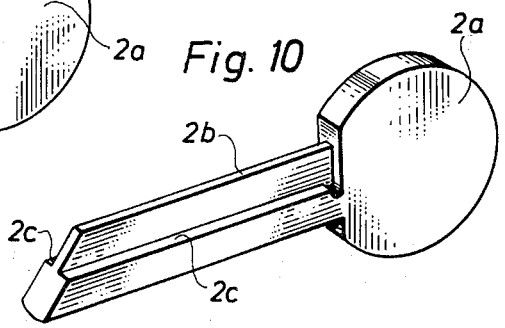

FIGS. 9 and 10 illustrate examples of key blanks which can be used for manufacturing keys for cylinder locks. According to FIGS. 5 to 8 each key blank has a head 2a, a blade 2b, and a side part 2c on each side of the blade, and the coded surfaces on the side part and blade would be cut into the blank. However, it would be possible to manufacture keys from blanks which do not have specifically identifiable side parts, the side parts being formed when the coded surfaces thereof are cut on the blank. For manufacturing a key suitable for the lock of FIGS. 1 to 4, a blank with a blade and a single side part would preferably be used.

Figure 11:
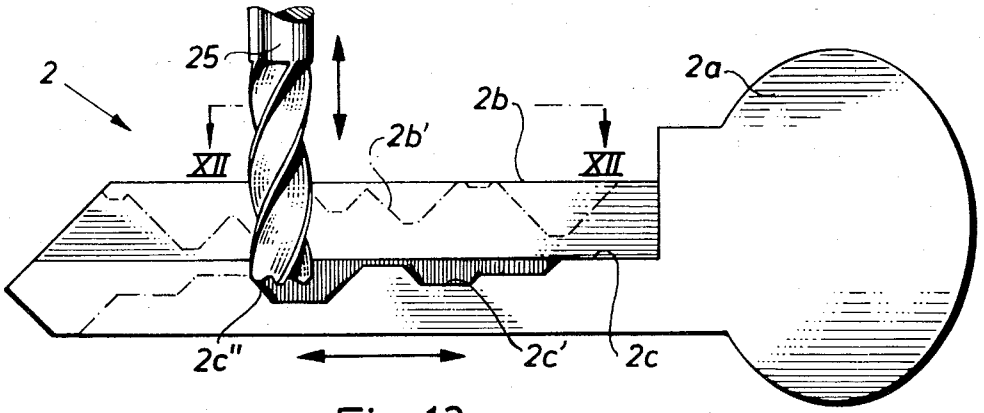
FIG. 11 is a side view illustrating a fundamental method of manufacturing a key from a key blank shown in FIG. 9 or 10.
Figure 12:
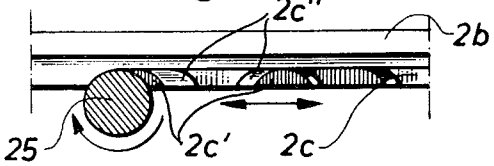
FIG. 12 is a sectional view taken on the line XII—XII in FIG. 11.

FIG. 11 illustrates the method employed for manufacturing a key from a key blank. As has been described, the coded surface on the side part 2c of the key geometrically is part of the surface defined by rotation of a point at a fixed distance from an axis which, relative to the key, lies parallel to the axes of the pins, the point moving parallel to the axis about which it rotates and the axes undergo movement relative to the key longitudinally thereof. In practical terms, this is achieved by use of a milling or drilling tool 25, the axis of the rotation of which is caused to take a position relative to the key substantially the same, in terms of distance and orientation, as that which the pins take relative to the key when the key is in the cylinder. As the tool 25 is rotated, it and/or the key blank are displaced relative to one another in directions along the axis of rotation of the tool and longitudinally of the key blank. These movements are illustrated by arrows in FIG. 11. FIG. 12 shows this operation in plan view.

The code 2b' on the blade of the key can be formed, conventionally, either before or after forming the coded surface on the side part of the key. Of course, if the lock has no conventional pin tumblers, the coded surface 2b can be omitted. As illustrated, the coded surface 2b' lies at a higher level than the coded surface of the side part, and this condition will usually be the case. However, the two coded surfaces may have parts which merge with each other.

In the above description, we have referred to the generation of the coded surface of the side part on the key by a cutter lying parallel to the pins relative to the key. However, a certain amount of deviation from the exactly parallel condition can be tolerated without detracting from the functional relationship between pins and coded surface.

I claim:

1. A cylinder lock comprising:

(a) a housing, (b) a cylinder core mounted for rotation in said housing, (c) a slot extending into the cylinder core parallel to the rotation axis thereof, for receiving a key, (d) at least one row of locking pins guided in bores in said cylinder core and being movable against spring means by a key which engages ends of the pins when the key is inserted into the slot, (e) at least one side bar accommodated in a recess extending axially in a peripheral part of the cylinder core, said at least one side bar being spring biassed outwardly of the cylinder into engagement with a recess in the housing which recess is shaped to retract the side bar in the cylinder core upon turning of the cylinder core, (f) said locking pins having operative waisted portions, and said at least one said side bar having a number of lugs which must engage in said waisted portions of said pins of a row to permit said retraction, said waisted portions of the pins of the or each row being identically positioned on said pins of said row with respect to said ends of the pins of the row, and said lugs being respectively positioned on said at least one side bar so as to engage said waisted portions when the pins of a row have been set in predetermined positions by the key when the key is in an operative position, (g) said at least one side bar including guide portions which extend between the pins of a row at least when the side bar is retracted into the cylinder and engage with surfaces in the cylinder to resist misalignment of the side bar.

2. A cylinder lock according to claim 1 wherein said lugs on said at least one side bar are disposed between said guide portions and are of arcuate shape, so as to engage a substantial part of the peripheral surface of said pins of a row, except when the key is in said operative position.

3. A cylinder lock according to claim 1 wherein at least one of said locking pins has a further waisted portion shallower than said operative waisted portion and which can be entered by a lug.

4. A cylinder lock according to claim 1 wherein at least one of said locking pins includes a plurality of operative waisted portions to permit lock opening by a master key.

5. A cylinder lock according to claim 1 including first and second rows of locking pins and first and second side bars each row and bar being arranged as claimed in any one of the preceding claims so that the first row and first side bar co-operate and the second row and second side bar co-operate, the pins of the first row being engageable by a coded surface formed in a longitudinal portion to one side of a blade of the key and the pins of the second row being engageable by a coded surface formed in a longitudinal portion to the other side of the blade of the key.

* * * * *